US005332510A

United States Patent [19]

Baur et al.

[11] Patent Number: 5,332,510

[45] Date of Patent: Jul. 26, 1994

[54] PROCESS FOR CLEANING ROLLING OILS

[75] Inventors: Rudolf Baur; Hanspeter Krähenbühl; Urs Giger; Emil Merki, all of Kreuzlingen, Switzerland

[73] Assignee: Alusuisse-Lonza Services Ltd., Zurich, Switzerland

[21] Appl. No.: 138,758

[22] Filed: Oct. 18, 1993

[30] Foreign Application Priority Data

Nov. 10, 1992 [CH] Switzerland ..... 03 470/92

[51] Int. Cl.[5] ..... C02F 1/54

[52] U.S. Cl. ..... 210/729; 208/180; 208/252; 210/787

[58] Field of Search ..... 210/728, 729, 787; 208/180, 252, 251 R

[56] References Cited

U.S. PATENT DOCUMENTS

| | | | |
|---|---|---|---|
| 2,631,979 | 3/1953 | McDermott . | |
| 3,095,368 | 6/1963 | Bieber et al. | 208/252 |
| 3,450,627 | 6/1969 | Johnson et al. . | |
| 3,523,895 | 8/1970 | Ishibashi et al. | 208/180 |
| 4,287,049 | 9/1981 | Tabler et al. | 208/180 |
| 4,522,729 | 6/1985 | Tabler | 208/180 |

FOREIGN PATENT DOCUMENTS

| | | | |
|---|---|---|---|
| 0009935 | 4/1980 | European Pat. Off. | 208/180 |
| 2613878 | 10/1976 | Fed. Rep. of Germany . | |
| 3342372 | 6/1984 | Fed. Rep. of Germany . | |

*Primary Examiner*—Neil McCarthy
*Attorney, Agent, or Firm*—Bachman & LaPointe

[57] ABSTRACT

Process for cleaning rolling oils which, when contaminated, contain rolling fines originating from metals being processed into semi-finished products in strip form, in particular light weight metals, e.g. aluminum fines. An addition of 2 to 8 g of dimeric oleic acid is made to each 1000 g of contaminated oil and the mixture passed through a coagulator whereby the rolling fines coagulate and can be readily removed from the contaminated oil. The purified oil can be recirculated as rolling oil.

8 Claims, 1 Drawing Sheet

PROCESS FOR CLEANING ROLLING OILS

BACKGROUND OF THE INVENTION

The present invention relates to a process for cleaning rolling oils contaminated with particles viz., rolling fines originating from metals, especially light weight metals being processed into a semi-finished strip product.

During cold rolling e.g. cold rolling aluminum, rolling fines are unavoidably formed in the mixed friction range. These fine aluminum particles, >0.1 μm in diameter, which are partially retained in the oil film on the rolled (hard) surface of the foil are referred to as smudge.

The larger fraction of the aluminum rolling fines formed during rolling is washed from the surface of the work rolls (roll roughness) into the recycled oil by the rolling oil (coolant and lubricant) sprayed onto the rolls.

These aluminum particles, which are formed as a result of friction, comprise an oil film that is physisorbed on the aluminum oxide surface layer of the metallic particle.

The aluminum particles suspended in the rolling oil exhibit like electrostatic surface surface charges (zeta potential) and so are not able to settle out under normal gravitation.

The rolling fines, present in the rolling oil as a suspension, exibit a distribution that is characteristic of the diameter of the particles. The total amount of rolling fines in the rolling oil is traditionally referred to as oxide ash, and can be determined gravimetrically (DIN-EN 7) or photometrically (% g/g).

A conventional method for cleaning rolling oils is by solid/liquid filtration. Particular preference is given to the Schneider filter. This fully automated multi-chamber vacuum plate type filter, consumes large amounts of filter paper strip and filtering agents (sand, organic absorbants).

Other cleaning systems that in use are e.g. filtering candles (sand-filled wire candles) and matting candle filters.

These filtration units require auxiliary materials such as e.g. filtration sand or organic filtration solids. In each case the disposal of these auxiliary materials is problematic and expensive.

By employing centrifuges it is possible to separate out only the coarser Al fines (larger than 0.5 μm). Combinations of centrifuges and filtration units have low efficiency as the length of time that the auxiliary materials can be employed is determined by the fraction of the finest aluminum fines.

If foil is to be rolled in superimposed pairs using cleaned rolling oil, it is essential to employ chamber type centrifuges after the cleaning operation, especially after a Schneider filter. Traces of "filter sand" that are carried over are precipitated out by the gravitational field of the centrifuge. During cold rolling, traces of "filter sand" in the rolling oil can lead to severe surface defects in the foil (fine porosity, commas, streaks etc.).

Chemical coagulation is known, for example from DE-PS 26 13 878, for cleaning rolling oils. The warm contaminated oil is passed through a coagulator and 0.5 to 1.5 liter of 15 to 25% aqueous sodium carbonate added at a throughput of 400 to 1200 liters per hour after which the coagulum is centrifuged off. Small amounts of hydrogen gas is formed in this process.

The known processes for cleaning rolling oils are not satisfactory in every respect; it is considered a disadvantage that, as only a fraction of the rolling oil is cleaned in parallel with the rest of the circulating rolling oil, complete removal of fines is not possible. Furthermore it is not possible to fully automate the cleaning process. The use of aqueous coagulating agents increases the risk of corrosion. The coagulum i.e. the precipitated colorant is not inhibited and can give off hydrogen.

SUMMARY OF THE INVENTION

The object of the present invention is to overcome these disadvantages and to offer a process, that makes it possible to achieve complete coagulation and with that complete separation of metallic fines from the the rolling oil, this without requiring an aqueous coagulating agent.

That object is achieved by way of the invention in that dimeric acid is added to the contaminated rolling oil in a concentration of 2 to 8 g of dimeric acid per 1000 g of contaminated rolling oil, and the mixture fed to a coagulator.

The dimeric acid is a dimerizing product of oleic acid. Oleic acid has the chemical formula:

$$CH_3(CH_2)_7CH{=}CH(CH_2)_7COOH$$

The dimers of oleic acid can be manufactured for example by thermal polymerization or alumina catalyzed polymerization. The dimeric acids are also known as polymerised fatty acids and exhibit an acid number (mg KOH/g) of, for example, 191 to 198 and a saponification number (mg KOH/g) of 195 to 205. The dimers can also contain intermediates (also called 1.5 mer) and/or trimers or comprise of trimers.

The dimeric acids are preferably added in quantities of 2 to 5 g, preferably 2 g, of dimeric acid per 1000 g of contaminated oil.

In practice the dimeric acids are employed in concentrations, for example, of 10–50%, preferably 25% dimeric acid (weight/volume) dissolved in a base oil comprising fresh or cleaned rolling oil.

The process according to the invention is to advantage suitable for cleaning contaminated rolling oils resulting from rolling metal foils such as aluminum foils. Consequently, the process is suitable for cleaning foil-rolling oils and hence for cleaning foil-rolling oils from the process of foil-rolling aluminum.

BRIEF DESCRIPTION OF THE DRAWINGS

The process according to the invention can be explained in greater detail with the aid of the machine assembly shown in FIG. 1.

DETAILED DESCRIPTION OF PREFERRED EMBODIMENT

Figure 1:
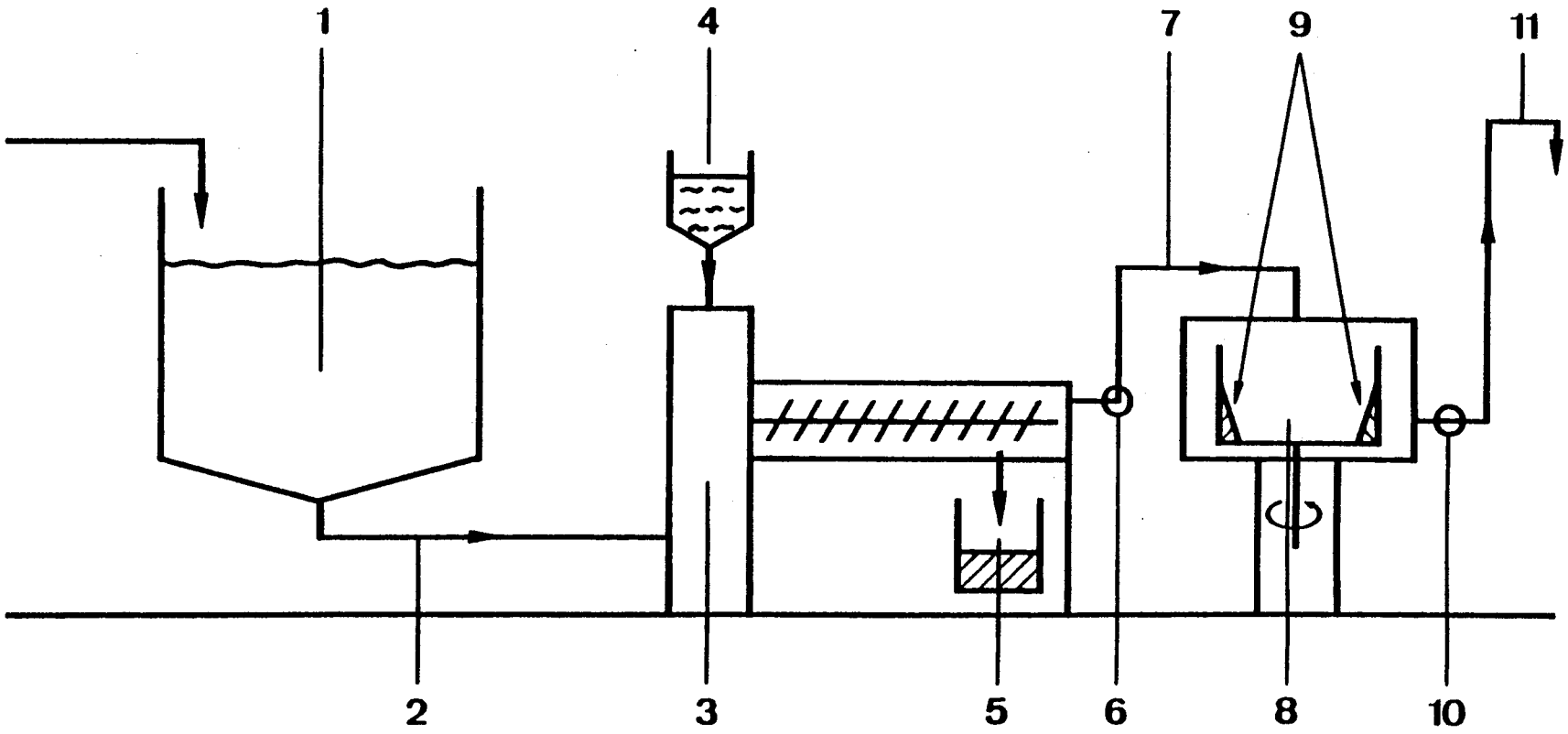

Contaminated oil is drawn continuously from a storage tank (1) and fed to the coagulator (3) via pipe (2). The dimeric solution, for example a 25% solution of dimers in the base oil (weight/volume), is situated in a storage tank (4). The dimeric solution mixes with the contaminated oil and is fed to the coagulator (3) featuring a decantation centrifuge; the finest of the fines coagulates and the coagulum is passed out of the coagulator (3) into receptacle (5). The pre-cleaned, contaminated oil can be conducted to a chamber type centrifuge (8) via pipe (7). The remaining fines are completely removed from the cogulum in the chamber type centrifuge (8). The arrows (9) indicate the sludge removed from the coagulum. The purified rolling oil can be fed back via pipe (11) to the rolling mill or to an intermediate storage tank.

Sites (6) and (10) indicate, by way of example, places of measurement where samples may be taken for analysis.

A vacuum plate filter may be provided instead of the chamber type centrifuge (8). Vacuum plate filters can be operated with the aid of paper filters and filtration agents such as sand for example.

A useful specific embodiment of the present invention is such that the mixture of contaminated oil and dimeric acid is fed to a coagulator. A further useful specific embodiment is such that the mixture is passed through a coagulator and then through a centrifuge.

A preferred version is such that the mixture is passed through a coagulator featuring a decantation centrifuge. A preferred version is such that the mixture is subsequently treated in chamber type centrifuge.

Particularly preferred is to treat the mixture in a coagulator with decantation centrifuge and then in a chamber type centrifuge.

The process according to the invention is conducted at temperatures of 60° to 100° C., preferably at 90° C.

The process in question can be operated in the main circuit or a parallel circuit of the rolling oil. If the process is incorporated in the main circuit, the parts of the unit, such as the coagulator for example, must be appropriately dimensioned. A degree of purification of rolling oil, measured in terms of the oxide ash content as in DIN-EN7 and amounting to or less than 0.01%, can be obtained. The residue contains only metal fines such as aluminum fines and rolling oil. As a rule about 1.3 kg waste material results from 1000 liters of rolling oil. This residue can be disposed of without harm, yielding about 350 g $Al_2O_3$ per 1000 liters of treated rolling oil.

The precipitation agent involved in the physical coagulation process i.e. the dimeric acid dissolved in the base oil is completely absorbed by the coagulating metal, e.g. aluminum fines and so does not enter the rolling oil.

If irregularities in the operation of the coagulator lead to dissolved dimeric acid entering the rolling oil, the following effects can be observed:

At a concentration of, or less than, 0.2% (g/v) this addition acts as a highly accelerates reaction lubrication during the cold rolling of aluminum foil. In connection with degrease annealing, this concentration of dimeric acid in the rolling oil, or oil film on the surface of the hard-rolled foil, has no effect on the tendency for strips of that material to stick together.

At a concentration of >0.5% (g/v) dimeric acid in rolling oil this addition no longer promotes lubrication. Its effect on degrease annealing is such that at this concentration of dimeric acid in the rolling oil, or in the oil film on the hard-rolled foil surface, it leads to a strong tendency for strips of foil to stick together.

Until the critical concentration of dimeric acid in foil-rolling oil is reached, an addition of e.g. 20 l of coagulating agent (25% g/v dissolved in the base oil) would have to be usefully made to 1000 l of rolling oil In order to avoid such critical concentrations control measures can be introduced viz., the outlet photometer cell of the coagulator blocking the supply of coagulating agent when a signal for complete coagulation is obtained.

EXAMPLE

In a unit as shown in FIG. 1 contaminated oil is removed at 12 l/min from a storage tank containing 2000 l. The contaminated oil is at a temperature of 90° C. Dimers dissolved in base oil (conc. 25% weight-/volume) are added to the contaminated oil at 0.025 l/min which is treated, first in a coagulator with a decantation centrifuge then in a chamber type centrifuge. Samples are taken at sites (6) and (10) as in FIG. 1. The values measured are presented in the following table:

| Coagulation | | | Tank | Analysis after coagulator (6) | | Analysis after centrifuge (10) | |
|---|---|---|---|---|---|---|---|
| Duration Min | Throughput l | Addition l | Rolling-oil-OA % (g/g) | Rolling oil-OA % (g/g) | Coagulum kg | Rolling-oil-OA % (g/g) | Sludge kg |
| 0 | 0 | 0 | 0.105 | 0.105 | 0 | 0.105 | 0 |
| 30 | 360 | 0.75 | 0.094 | 0.009 | 3 | 0.002 | |
| 165 | 1980 | 4.1 | 0.062 | 0.009 | 5 | 0.002 | |
| 450 | 5400 | 11.25 | 0.035 | 0.034 | 7.5 | 0.018 | |
| 1410 | 16'920 | 0 | 0.036 | 0.029 | 8.5 | 0.022 | 1.2 |

Ledgend
Duration: Duration of coagulation treatment (Min)
Throughput: Amount of foil-rolling oil in liters
Addition: Dimers 25% (g/v) dissolved in base oil
Rolling oil OA: Oxide ash content, determined acc. to DIN-EN7

We claim:

1. Process for cleaning rolling oils which comprises: providing rolling oil contaminated with aluminum rolling fines originating from aluminum metals; adding from 2 to 8 g of dimeric oleic acid to each 1000 g of contaminated oil to form a mixture; and coagulating the mixture.

2. Process according to claim 1 wherein the mixture is preliminarily coagulated and is then centrifuged or filtered in a vacuum plate filter.

3. Process according to claim 2 wherein the mixture is passed through a decantation centrifuge and then through a chamber type centrifuge.

4. Process according to claim 1 wherein the process is conducted at temperatures of 60° C. to 100° C.

5. Process according to claim 4 wherein the process is conducted at 90° C.

6. Process according to claim 5 wherein an addition of 2 to 5 g dimeric oleic acid is made to each 1000 g of contaminated oil.

7. Process according to claim 1 wherein the dimeric oleic acid is employed in the form of a 10 to 50% solution dissolved in base oil.

8. Process according to claim 7 wherein a 25% solution is employed.

* * * * *